US006450079B1

(12) United States Patent
Bourdin et al.

(10) Patent No.: US 6,450,079 B1
(45) Date of Patent: Sep. 17, 2002

(54) DEVICE FOR AFFIXING A MUZZLE BRAKE TO A WEAPON BARREL

(75) Inventors: Jean-Claude Bourdin, Bourges; Alain Charton, Crosses, both of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/583,174

(22) Filed: May 30, 2000

(30) Foreign Application Priority Data

May 27, 1999 (FR) ..... 99 06748

(51) Int. Cl.[7] ..... F41A 21/36
(52) U.S. Cl. ..... 89/14.3
(58) Field of Search ..... 89/14.3

(56) References Cited

U.S. PATENT DOCUMENTS

| | | | | | |
|---|---|---|---|---|---|
| 2,212,683 | A | * | 8/1940 | Hughes | 89/14.3 |
| 2,212,686 | A | * | 8/1940 | Hughes | 89/14.3 |
| 2,629,958 | A | * | 3/1953 | Roper et al. | 89/14.3 |
| 3,455,203 | A | | 7/1969 | Pillersdorf | 89/14.3 |
| 4,545,285 | A | | 10/1985 | McLain | 89/14.3 |
| 5,794,374 | A | | 8/1998 | Crandall | 42/97 |

FOREIGN PATENT DOCUMENTS

| | | | | | |
|---|---|---|---|---|---|
| EP | 0 723 131 | A1 | | 7/1996 | 89/14.3 |
| FR | 656608 | | * | 5/1929 | 89/14.3 |
| FR | 795235 | | * | 3/1936 | 89/14.3 |
| FR | 812680 | | * | 5/1937 | 89/14.3 |
| FR | 1063518 | | * | 5/1994 | 89/14.3 |
| GB | 454533 | | * | 10/1936 | 89/14.3 |

* cited by examiner

*Primary Examiner*—Stephen M. Johnson
(74) *Attorney, Agent, or Firm*—Parkhurst & Wendel, LLP

(57) ABSTRACT

A weapon barrel muzzle brake (5) with elements for fixing the muzzle brake to a weapon barrel (4) having a forward muzzle end face with external coupling threading (9) in the external surface of the forward end of the barrel, and an externally cylindrical rest surface (7) between the external threading and the muzzle end face, the muzzle brake (5) having internal coupling threading (13) for engaging external coupling threading on a weapon barrel, a radially extending rest wall (15) for abutting the end face (10) of a weapon barrel muzzle, and an internally cylindrically rest surface (14) for fitting snugly over an external rest surface on a weapon barrel, and locking stop elements (16–19) for preventing rotation of the muzzle brake with respect to a weapon barrel.

9 Claims, 3 Drawing Sheets

DEVICE FOR AFFIXING A MUZZLE BRAKE TO A WEAPON BARREL

The present invention relates to means for affixing a muzzle brake to the barrel of medium or large caliber firearm.

BACKGROUND OF THE INVENTION

To reduce stresses exerted by the combustion gases of the propellant charge of a munition in a weapon, it is well known to attach a muzzle brake to the free end of the arm's barrel to generate a force opposing those caused by the gases. The widely used muzzle brakes, in particular for big artillery guns, are relatively heavy and thereby impair the weapon's balance. In general such muzzle brakes are affixed by means of threads cooperating with components such as a mating nut, a spring washer, a pin and the like. The weights and the costs of these components are significant. Moreover the mechanical strength of the barrel is decreased by a channel receiving the pin, especially when this pin projects beyond the barrel tip, and related machining on the barrel and brake further increase the costs of such designs.

Illustratively the French Patent document 2,718,839A discloses a muzzle brake completely enclosing the free end of a weapon barrel. This muzzle brake is affixed to the barrel by threads, a lock nut making it possible to fix their relative axial positions. A screw-tightened pin makes the muzzle brake non-rotational relative to the barrel.

Swiss Patent document 240,479A and French patent document 715,769A discuss a muzzle brake screwed onto the front end of a weapon barrel. This brake extends the barrel and rests on its front face. Neither document describes any stop means.

BRIEF SUMMARY OF THE INVENTION

The objective of the present invention is to create a fixation En device for a muzzle brake on a weapon barrel, wherein the affixation is implemented using a lesser number of elements.

Accordingly, an object of the invention is a fixation device for a muzzle brake on a weapon barrel by means of a threaded coupling, the muzzle brake comprising a rest surface cooperating with the front end face of the barrel, said fixation device being characterized in that the barrel is fitted with a front cylindrical rest surface situated ahead of the threaded coupling cooperating with a corresponding rest surface of the brake assuring brake centering, and in that it comprises at least one stop precluding rotation and situated between the muzzle brake and the barrel.

In one feature of the invention the barrel comprises a rear rest surface cooperating with a matching rest surface of the brake and situated opposite the front rest surface relative to the threaded coupling.

Another feature of the invention is a stop situated near a centering rest surface and comprising at least a tightening screw mounted transversely between the muzzle brake and the barrel. That screw presses against a flat surface in the thickness of the barrel and comprises a rotation-precluding stop which may be a locknut.

Advantageously the tightening screw and the flat surface are configured in such a way that tightening the screw prestresses the threaded coupling while generating an additional tightening torque exerted by the muzzle brake on the barrel.

Another feature of the invention is the axis of the tightening screw running parallel to a barrel diameter and transversely to the flat surface, with the screw axis situated a distance D from the barrel axis approximately 0.3 to 0.7 times the length of the outside radius of the barrel. Preferably two tightening screws are configured symmetrically to the barrel axis.

In another embodiment of the invention the fixation device of a muzzle brake comprises a shim situated between the barrel's front end face and the wall of the muzzle brake.

The advantage of the fixation device of the invention for a muzzle brake is its simplicity, reducing its overall weight.

BRIEF DESCRIPTION OF THE DRAWINGS

Other features, details and advantages of the invention are elucidated in the following illustrative description and in relation to the attached drawings.

DETAILED DESCRIPTION

Figure 1:
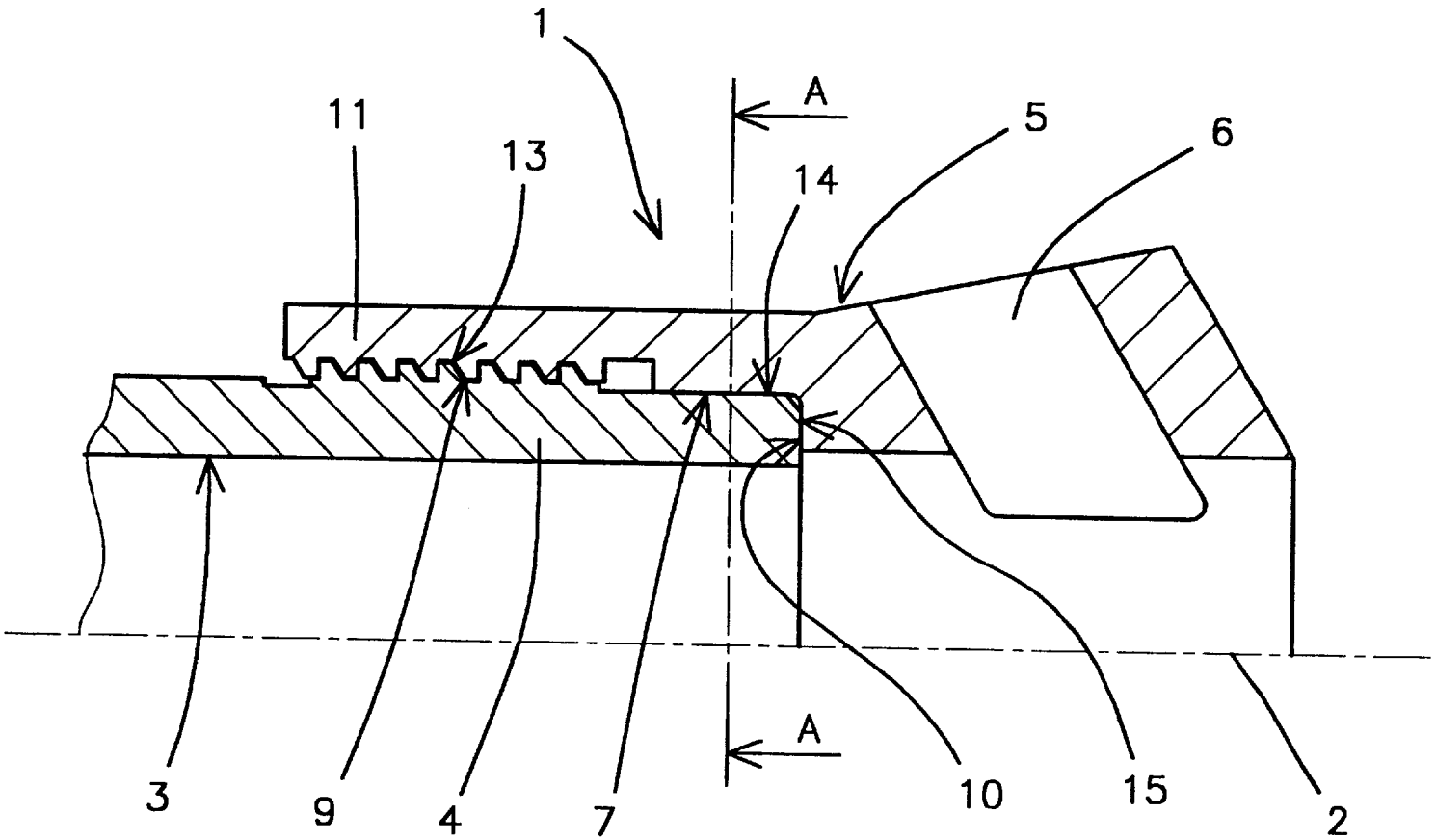
FIG. 1 is half an axial cross-sectional view of a weapon barrel and a the muzzle brake of the invention.

FIG. 1 shows a fixation device 1 in partial axial section along the axis 2 of the barrel 3 of a weapon (not fully shown). The end 4 of the barrel 3 seats a muzzle brake 5 conventionally comprising vanes 6 for directing the combustion gases of a propellant charge. The end 4 of the barrel 3 comprises a cylindrical front rest surface 7 and threading 9. The front end face 10 of the barrel is substantially perpendicular to the axis 2. The muzzle brake 5 comprises an elongated tubular stub 11 which will engage barrel end 4. Stub 11 is fitted with threading 13 meshing with threading 9, and a front rest surface 14 cooperating with the barrel rest surface 7 to assure centering. The brake also comprises a transverse inner wall 15 that will contact the barrel's front end face 10. When the wall 15 rests against the barrel's front end face 10, the muzzle brake as shown will have been fully screwed-on. In this manner no play remains between the barrel's front end face 10 and the wall 15. Thus, propulsion gases generated by a propellant charge are prevented from passing through the threads. As a result the muzzle brake of the invention offers improved sealing over the muzzle brakes of the known state of the art.

Vanes 6 of muzzle brake 5 are configured in such manner that the combustion gases of a munition propellant charge will be evacuated sideways in a horizontal plane relative to the weapon barrel. For that purpose and in known manner, the first turn of the thread 9 is directed relative to positioning means on the weapon (not shown), for example relative to a pin groove linking the breech and the barrel, the first turn of the thread 13 of the muzzle brake being directed relative to the vanes 6.

The threads 9 and 13 are shown in a so-called trapezoidal "artillery" shape, though any other threading form also may be used.

Figure 2:
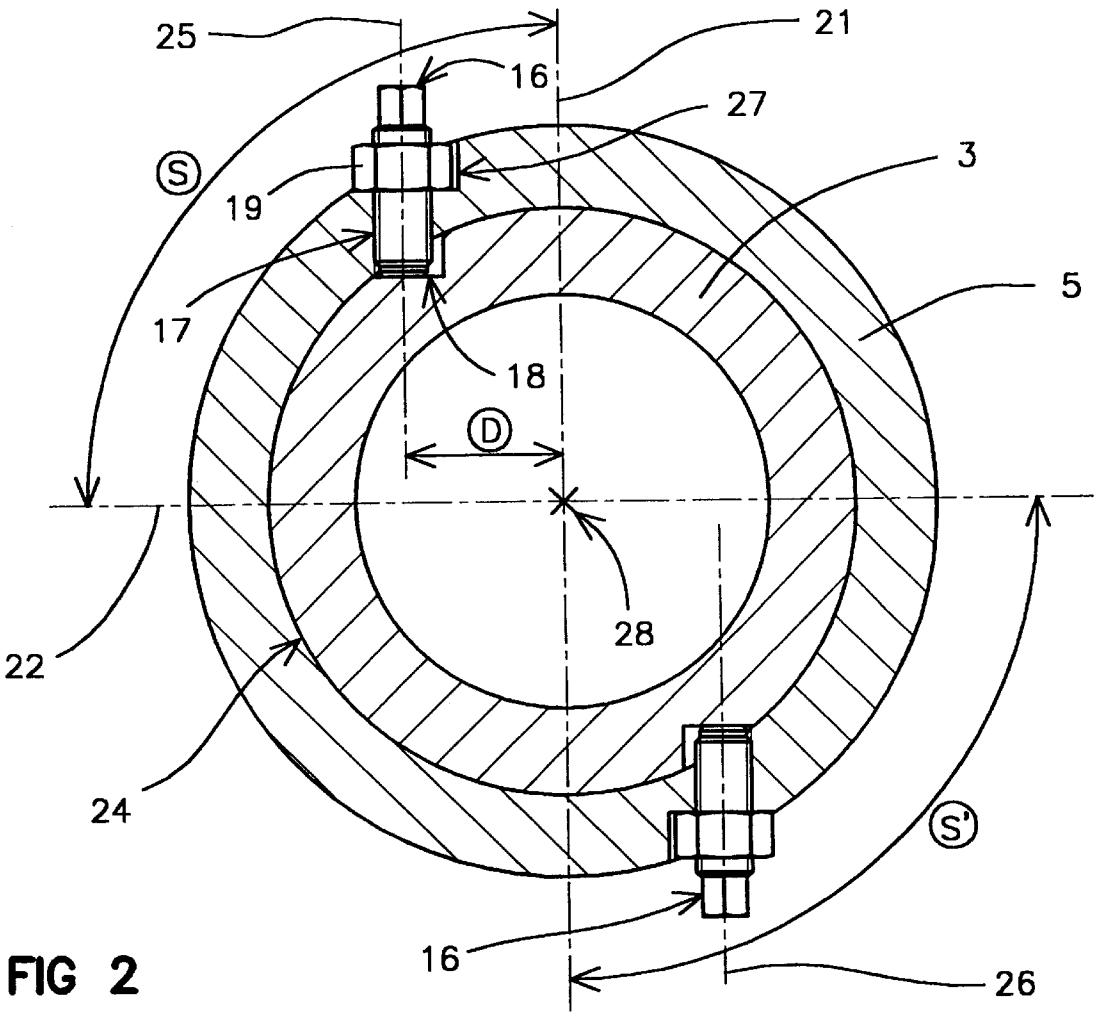
FIG. 2 is a diametric cross-sectional view of the barrel and muzzle brake in the area of the tightening bolts and along the plane AA of FIG. 1.

FIG. 2 is a radial cross-section of barrel 3 in the zone of the means blocking rotation of the muzzle brake relative to the barrel. These means are situated in the zone of the centering rest surfaces 7 and 14 and comprise two tightening bolts 16 screwed into threads 17 in said brake and resting against a flat surface 18 on the outside of the barrel 3, perpendicular to the thread axis 25. Illustratively each bolt 16 is prevented from rotating by a locking nut 19 housed in a cut 27. These bolts 16 are configured as a function of the direction of the pitch of the threads 9 and 13 in such a way that tightening these bolts prestresses the threaded coupling by generating an additional tightening torque exerted by the muzzle brake on the barrel.

In the embodiment shown in FIG. 2, the bolts 16 are situated in the quadrants S' and is S' bounded by the two mutually perpendicular barrel diameters 21 and 22. The respective axes 25 and 26 of the bolts are parallel to barrel diameter 21, and tightening the bolts biases the muzzle brake to rotate clockwise corresponding to a right-handed thread.

The bolt axis is located a distance D from the axis 28. Advantageously and to implement an appropriate locking torque while retaining the mechanical strength of the barrel in the vicinity of machined flat surface 18, the distance D is about 0.3 to 0.7 times the length of the outside radius 24 of the barrel 3.

Even though in FIG. 2 two diametrically opposite locking means are shown, as preferred, nevertheless a single means may be adequate in some instances.

The tightening threads 17 and the flat surface 18 in the thickness of the barrel are machined in such manner that they are mutually opposite when the muzzle brake assumes the locking position on the weapon's barrel. To attain this goal, the threads 17 and the flat surface 18 are respectively directed relative to the muzzle brake's vanes 6 and created when machining the barrel position on the weapon takes place.

The muzzle brake is installed in the following manner. The brake is mounted around the free end of barrel 3 and then screwed-on until there is hard contact between the barrel's front end face 10 and the wall 15. As screwing proceeds, the respective rest surfaces 7 and 14 make close contact. The orientation of the initial thread turns permits appropriately positioning the muzzle brake and its vanes 6 as well as threads 17 and the flat surfaces 18. Thereupon the bolts 16 are tightened, and they implement a tightening and prestressing torque between the threads 13 and 9. Next the locking nuts 19 are tightened. As a result the bolts 16 prevent loosening of the muzzle brake.

Figure 3:
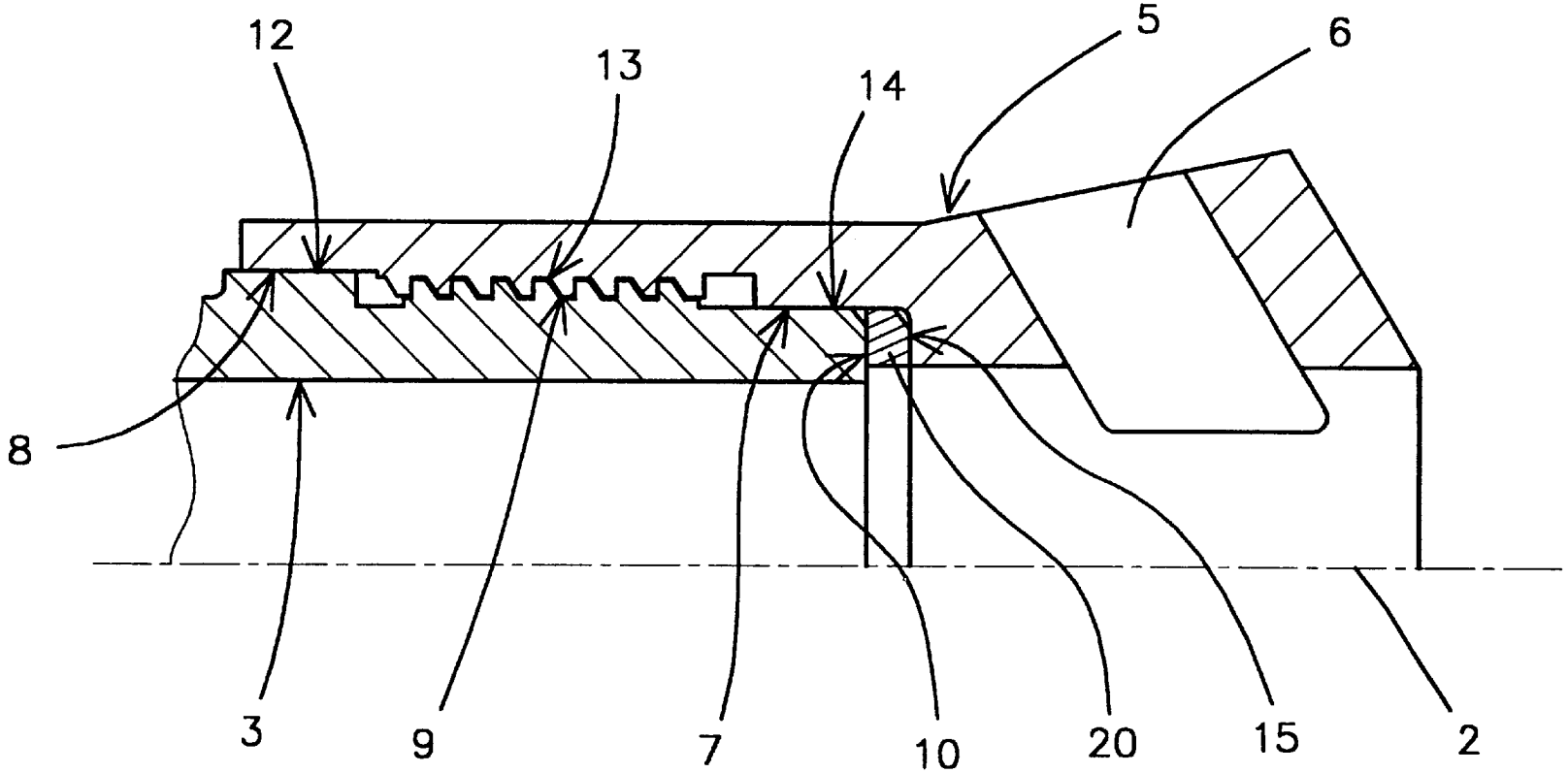
FIG. 3 is a half of an axial cross-sectional view showing another embodiment of the fixation device of the invention.

FIG. 3 shows a variation of the device fixing a muzzle brake 5 on a weapon's barrel 3. This embodiment variation comprises a second centering means of the muzzle brake on the barrel. Accordingly the barrel is fitted with a second rest surface 8 cooperating with a muzzle-brake rest surface 12, said rest surfaces being to the rear of the threaded coupling 9, 13.

Installing the muzzle brake 5 as shown in FIG. 3 includes a shim 20 between the front end face 10 of the barrel 3 and the wall 15 of the muzzle brake 5. The shim may assume the shape of a variable-thickness washer, the thickness being adjusted as needed when the muzzle brake is installed. In this embodiment, the initial thread turns are not configured in relation to any reference, and as a result machining the threads 9 and 13 is simplified.

The muzzle brake is installed in the following way. The brake is mounted around the free end of the barrel 3 and then is screwed-on until there is firm contact between the barrel's front end face 10 and the wall 15. In general, in this position, the muzzle brake's vanes 6 are not finally directed. Next the muzzle brake is unscrewed until the vanes assume an appropriate lateral position. Thereupon the clear space between the barrel's front end face 10 and the muzzle brake's wall 15 is measured, and a shim of a thickness matching the measurement is made. The muzzle brake is withdrawn to place the shim 20 against the brake's wall 15, and this brake then is screwed-in again until it comes to a stop, whereby the vanes 6 are then in the proper position. Finally, the bolts 16 and the locking nuts are tightened.

In this latter embodiment, the means preventing the muzzle brake from rotation relative to the barrel can be situated near the forward centering rest surfaces 7, 14, or near the rear centering rest surfaces 8, 12.

Only one centering means 7, 14 may be used in still another embodiment, and with respect to the embodiment shown in FIG. 1, two rest surfaces might be used.

When intervention is required, the fixation device of the invention advantageously assures very easy disassembly of the muzzle brake from the weapon's barrel.

Those skilled in the arts of weapon design and muzzle brake design will appreciate that various modifications in the basic form of the invention as described herein can be made without departing from the scope and spirit of the invention as defined in the following claims.

What is claimed is:

1. A muzzle brake in combination with a weapon barrel, the muzzle brake comprising:

a generally cylindrical portion having in its axially rearward inner cylindrical surface internal coupling threading for engaging external coupling threading on the weapon barrel, said portion having a radially extending bearing surface for abutting a forward end face of a muzzle end of the weapon barrel and an internal cylindrical bearing surface for fitting snugly over an external cylindrical bearing surface of said weapon barrel near the muzzle end thereof, said internal cylindrical bearing surface being located axially between the internal threading and the radially extending bearing surface of the cylindrical portion; and at least one locking stop for preventing rotation of the cylindrical portion with respect to the weapon barrel when the cylindrical portion is coaxially fitted over the muzzle end of the weapon barrel, said at least one locking stop including at least one screw-threaded tightening bolt arranged to extend through the circumferential thickness of the cylindrical portion and seat into a recess in the outer surface of the weapon barrel, the longitudinal axis of the tightening bolt lying in a plane substantially perpendicular to the longitudinal axis of the brake and barrel and offset from a radial axis of said brake and barrel, said at least one screw-threaded tightening bolt arranged to abut a substantially flat surface portion of said recess in the barrel.

2. A muzzle brake in combination with a weapon barrel, the muzzle brake comprising:

a generally cylindrical portion having in its axially rearward inner cylindrical surface internal coupling threading for engaging external coupling threading on the weapon barrel, said portion having a radially extending bearing surface for abutting a forward end face of a muzzle end of the weapon barrel and an internal cylindrical bearing surface for fitting snugly over an external cylindrical bearing surface of said weapon barrel near the muzzle end thereof, said internal cylindrical bearing surface being located axially between the internal threading and the radially extending bearing surface of the cylindrical portion; and at least one locking stop for preventing rotation of the cylindrical portion with respect to the weapon barrel when the cylindrical portion is coaxially fitted over the muzzle end of the weapon barrel, said at least one locking stop including at least one screw-threaded tightening bolt arranged to extend through the circumferential thickness of the cylindrical portion and seat into a recess in the outer surface of the weapon barrel, the longitudinal axis of the tightening bolt lying in a plane substantially perpendicular to the longitudinal axis of the brake and barrel and offset from a radial axis of said brake and barrel, wherein the tightening bolt, the recess in the barrel, and the pitch of the coupling threading are configured so that a tightening rotation of the tightening bolt extends the tightening bolt further in a direction toward the recess in the barrel, applies additional rotational torque to the brake and thereby tightens the brake on the coupling threading of the barrel.

3. A muzzle brake in combination with a weapon barrel, the muzzle comprising:

a generally cylindrical portion having in its axially rearward inner cylindrical surface internal coupling threading for engaging external coupling threading on the weapon barrel, said portion having a radially extending bearing surface for abutting a forward end face of a muzzle end of the weapon barrel and an internal cylindrical bearing surface for fitting snugly over an external cylindrical bearing surface of said weapon barrel near the muzzle end thereof, said internal cylindrical bearing surface being located axially between the internal threading and the radially extending bearing surface of the cylindrical portion; and at least one locking stop for preventing rotation of the cylindrical portion with respect to the weapon barrel when the cylindrical portion is coaxially fitted over the muzzle end of the weapon barrel, said at least one locking stop including at least one screw-threaded tightening bolt arranged to extend through the circumferential thickness of the cylindrical portion and seat into a recess in the outer surface of the weapon barrel, the longitudinal axis of the tightening bolt lying in a plane substantially perpendicular to the longitudinal axis of the brake and barrel, said at least one screw-threaded tightening bolt threadingly engaging a stopping lock nut.

4. The muzzle break of claim 3, wherein said cylindrical portion is configured to be fitted over the muzzle end of said weapon barrel, with the internal coupling threading of the cylindrical portion engaged with the external coupling threading of the barrel, and the internal cylindrical bearing surface of the brake snugly fitted over the external cylindrical bearing surface of the barrel.

5. The muzzle brake of claim 3, wherein the at least one locking stop is arranged to be located along the longitudinal axis of the weapon barrel and the cylindrical portion, respectively, within the axial length of the external cylindrical bearing surface of said weapon barrel.

6. The muzzle brake of claim 3, wherein the axis of the tightening bolt is substantially parallel to a diameter of the barrel and substantially perpendicular to a flat surface in the recess of the barrel.

7. The muzzle brake of claim 3, wherein the longitudinal axis of the tightening bolt is located a distance D normal to the longitudinal axis of the barrel, wherein D is about 0.3 to about 0.7 times the length of the external radius of the barrel.

8. The muzzle brake of claim 3, comprising two said tightening bolts located symmetrically with respect to the cylindrical portion axis and barrel axis.

9. The muzzle brake of claim 3, further comprising a shim member located between said forward end face of the muzzle end of the barrel and the radially extending bearing surface of the cylindrical portion.

* * * * *